US005601644A

United States Patent [19]

Yasoshima

[11] Patent Number: 5,601,644

[45] Date of Patent: Feb. 11, 1997

[54] MULTICOLOR STAMP PAD

[75] Inventor: Ryo Yasoshima, Tokyo, Japan

[73] Assignee: Tsukineko, Inc., Redmond, Wash.

[21] Appl. No.: 446,205

[22] Filed: May 19, 1995

[51] Int. Cl.[6] ..... B41K 1/42

[52] U.S. Cl. ..... 118/46; 118/264; 118/270; 101/333; 101/334; 101/327

[58] Field of Search ..... 101/333, 334, 101/327; 118/46, 264, 270

[56] References Cited

U.S. PATENT DOCUMENTS

| | | | |
|---|---|---|---|
| D. 184,720 | 3/1959 | Fleming . | |
| D. 247,063 | 1/1978 | Funahashi | D64/10 |
| D. 252,935 | 9/1979 | Henkels | D19/77 |
| D. 331,418 | 12/1992 | Winston | D18/15 |
| D. 345,826 | 4/1994 | Byars et al. | D28/83 |
| D. 347,089 | 5/1994 | Byars et al. | D28/83 |
| 602,061 | 4/1898 | Echelberger | 118/264 |
| 848,063 | 3/1907 | Sommer | 118/264 |
| 1,173,092 | 2/1916 | Bickerton | 118/270 |
| 1,463,718 | 7/1923 | Munson | 118/264 |
| 1,598,538 | 8/1926 | Mann | 118/269 |
| 1,796,137 | 3/1931 | Baumgarten | 118/264 |
| 2,117,470 | 5/1938 | Zareko | 118/264 |
| 2,290,488 | 7/1942 | Munson | 118/264 |
| 2,374,198 | 4/1945 | Harris . | |
| 2,422,814 | 6/1947 | Alexander . | |
| 2,723,476 | 11/1955 | Lyon . | |
| 3,326,180 | 6/1967 | Lofgren . | |
| 3,590,734 | 7/1971 | Carter | 101/333 |
| 4,029,011 | 6/1977 | Kurner . | |
| 4,986,175 | 1/1991 | Boehringer et al. | 101/125 |

FOREIGN PATENT DOCUMENTS

| | | | |
|---|---|---|---|
| 546609 | 9/1957 | Canada | 101/333 |
| 167380 | 1/1986 | European Pat. Off. . | |
| 2675740 | 10/1992 | France . | |
| 662905 | 6/1938 | Germany . | |
| 4-312881A | 11/1992 | Japan . | |
| 4940 | of 1896 | United Kingdom | 118/264 |
| 2045687 | 11/1980 | United Kingdom . | |

OTHER PUBLICATIONS

Rubber stamp catalog, Clearsnap, Inc., 1990.

Tsukineko, Color Palette Pigment Stamp Pad Catalog, Japanese language document.

Tsukineko, Japanese Catalog, 1993.

Clearsnap, Color Box Pigment Stamp Pads, See circled stamp pad, top left, 1993.

Ink–A–Dink–A–Do, *4 Inks in Ones*, Stamp Pad.

*Primary Examiner*—Donald E. Czaja
*Assistant Examiner*—Calvin Padgett
*Attorney, Agent, or Firm*—Seed and Berry LLP

[57] ABSTRACT

An multicolor stamp pad comprising a plurality of ink pads arranged in a line and suitable for use with a multitude of different aqueous dye-based inks, and methods of using the same. The plurality of ink pads are retained on an extension member that permits adjacent ink pads to contact one another when the extension member is retracted, (e.g., in use) while maintaining the plurality of ink pads in separation when the extension member is extended (e.g., in storage). The multicolor stamp pad suitable may also have disposed between the ink pads a flexible, thin, aqueous-impermeable film, such as a thin plastic film.

18 Claims, 6 Drawing Sheets

MULTICOLOR STAMP PAD

TECHNICAL FIELD

The present invention pertains to a multicolor stamp pad obtained by arranging a number of colored pads of different colors in a line.

BACKGROUND OF THE INVENTION

Stamps and stamp pads have been widely used heretofore because figures such letters, symbols, graphics, etc., can be reproduced easily by stamp imprinting. Stamp pads usually consist of a single color, such as black, red, or blue, and are primarily used for office applications.

In contrast to such single-color stamp pads, multicolor pad stamp pads in which a number of colored pads with different colors are arranged in a line have become commercially available in recent years. FIG. 11 is a schematic cross sectional view that illustrates an example of a conventional multicolor stamp pad. As shown in the figure, with a conventional multicolor stamp pad, a depression (22) is formed on a base (21). To the aforementioned depression (22) are adhered a line of colored pads (23) of different colors, obtained by allowing ink holders that are sponges (20) to absorb liquid pigment-based inks having a certain level of viscosity and thixotropy. The aforementioned colored pads (23) are fastened so that their tops protrude from the base (21). The tops of the colored pads (23) are covered by a lid (24). In addition, a groove (25) is formed around the base (21). Thus the edge surrounding the lid (24) can be joined to the aforementioned groove (25) to close the lid in a freely attachable and detachable manner.

When the aforementioned multicolor stamp pad is to be used in imprinting a rubber stamp that is smaller than the colored pads, it is possible to imprint the stamp in the desired color by selecting the color from the colored pads in multiple colors. If, however, the rubber stamp is larger than the colored pads, the rubber stamp is lightly pressed against the colored pads in multiple colors to ink it, after which the stamp is applied to the desired object (e.g., paper). Thus a single graphic on the rubber stamp can be printed in multiple colors. For example it is possible to obtain images consisting of a variety of different colors, such as a rainbow. This is especially popular with women and children.

Because liquid pigment-based inks are used on the multicolor colored pads consisting of various colors on the conventional multicolor stamp pad described above, the ink will not shift among the various colored pads even if adjacent colored pads touch each other directly. Thus the inks are never mixed together.

However, with the aforementioned multicolor stamp pad, if aqueous dyebased inks in particular are used and colored pads adjacent to each other make direct contact, ink will shift between the adjacent colored pads. As time passes the movement of ink back and forth causes the colors on the colored pads to change. As a result the original colors cannot be maintained.

In order to solve the problems that occur when such aqueous dye-base inks are used, adjacent pads have heretofore been separated from each other by various methods.

For example, as shown in FIG. 12, the individual colored pads (23) on the multicolor stamp pad can be partitioned using a plastic partitioning plate (26). This prevents the inks from mixing with each other. When the pads are to be used the aforementioned plastic partitioning plate is removed. With this method, however, removing the plastic partitioning plate is bothersome. In addition, after the plastic partitioning plate is removed spaces remain between the colored pads. This is problematic in that in some areas no color is applied in cases where a multicolor stamp image is to be imprinted.

In addition, there are multicolor pad stamp pads in which colored pads consisting of two colors are situated in small separate containers; these two containers are housed in the stamp holder base, and the individual colored pads are partitioned from each other by the walls on the small containers. This method, however, is problematic in that only a small number of colored pads are housed in the stamp holder, and multicolor stamp images cannot be imprinted because the colored pads are partitioned by the walls of the small containers.

SUMMARY OF THE INVENTION

As a result of various studies aimed at overcoming problems such as those described above, the present invention has the objective of providing a multicolor stamp pad utilizing aqueous dye-base inks, wherein when not in use the adjacent colored pads are pulled back to form spaces between them, thereby maintaining them so that they do not touch each other, and during use the adjacent pads are allowed to touch each other. Thus the transfer of inks between colored pads can be prevented to a considerable extent. The present invention provides these and other related advantages.

In addition, the present invention provides a multicolor stamp pad wherein, when it is not in use, the adjacent colored pads are pulled back to form spaces between them, thereby maintaining them so that they do not touch each other. In addition, a flexible thin film, which will not scratch the surface of the rubber stamp being used even if used without modification, is situated on surfaces of the colored pads where adjacent colored pads touch each other, making it possible to completely prevent the transfer of inks between the colored pads because of the thin film, even if the adjacent colored pads touch each other during use.

More specifically, the present invention is a multicolor stamp pad obtained by arranging a number of colored pads of different colors in a line, wherein the multicolor stamp pad is characterized in that a number of colored pads are set in a line on an extension member that extends and retracts freely.

Thus, in a first aspect the present invention provides a multicolor stamp pad comprising a plurality of ink pads disposed in a line on an extension member such that the ink pad contact one another when the extension member is retracted and do not contact one another when the extension member is extended. Preferably, the extension member is selected from the group consisting of a rubber plate; an N-shaped spring substrate comprising a plurality of ink pad areas, the substrate further comprising a first cut in a region between two of the ink pad areas, the first cut extending into the region from a rear edge of the spring substrate, and a second cut in the interpad area, the second cut substantially parallel to the first cut and extending into the region from a second edge of the spring substrate; one or both of rubber bands or extensible fiber strings, the rubber bands or fiber strings linking together the plurality of ink pads; an extendible and retractable plastic film, or a spring.

In a preferred embodiment, a plurality of pad bases are disposed between the plurality of ink pads and the rubber plate. In another preferred embodiment, a first end of the extension member is fastened to a base of the stamp pad and a second end of the extension member is attached to a handle capable of extending and retracting the extension member. In an additional preferred embodiment, the expandable stamp pad of any one of claims 1–10 in which a flexible thin, water-impermeable film is adhered to at least one side of the ink pads that makes contact with adjacent ink pads.

These and other aspects of the present invention will become evident upon reference to the following detailed description and attached drawings.

DETAILED EXPLANATION OF THE INVENTION

The present invention will be explained in detail below.

Figure 1A:
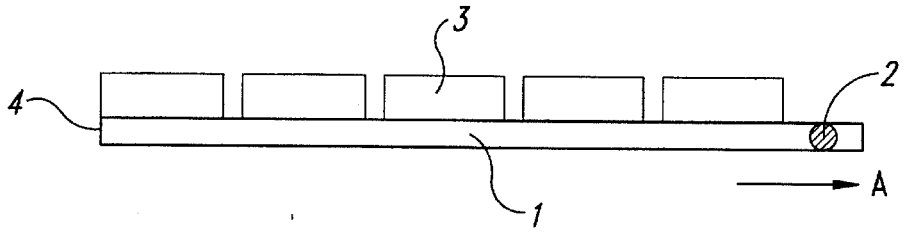
FIGS. 1A–1C depicts a side view of a stamp pad of the present invention wherein upper view (a) depicts the ink pads of the stamp pad in a separated state, middle view (b) depicts the ink pads of the stamp pad in contact, and lower view (c) depicts the ink pads of the stamp pad in contact, with a thin water-impermeable film disposed between adjacent ink pads.
Figure 1B:
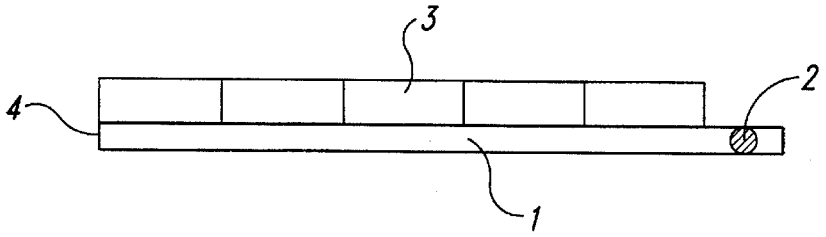
Figure 1C:
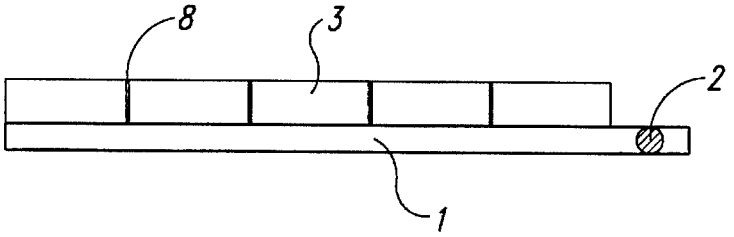

FIG. 1 is an explanatory diagram that illustrates the multicolor stamp pad mechanism of the present invention. In FIG. 1 the multicolor stamp pad of the present invention comprises a number of colored pads (3) such as small poem cards aligned on an extension member (1) that extends and retracts freely. A stationary end (4) is fastened on one end of the extension member (1), and an extension lever (2), or handle, is attached to the other end. When not in use, the extension lever (2) is pulled in direction A as shown in FIG. 1(*a*) so as to maintain the aforementioned extension member (1) in a stretched condition. Thus the colored pads (3) are held separate from each other. When in use, the tension on the extension lever (2) is released as shown in FIG. 1(*b*), restoring it to its original position and allowing the extension member (1) to retract. As a result, the colored pads (3) are brought into close contact with each 10 other directly, or are brought into close contact with each other but separated by a thin film (8) as shown in FIG. 1(*c*).

With the present invention, a flexible fibrous material such as felt is normally used for the colored pads. The aforementioned colored pads are aligned on an extension member that extends and retracts freely. The aforementioned extension member may house the colored pads directly or comprise a pad base that houses the colored pads.

An example of an extension member that houses colored pads directly is an N-shaped spring substrate composed of a rubber plate or plastic substrate, etc., that serves as a flexible unit. Cuts are made on the borders between the areas where the individual pads are to be situated on the aforementioned plastic substrate. When stretched, the cuts are extended in an N shape, providing a springing function. N-shaped spring substrates are especially useful in terms of industrial considerations because they permit the simultaneous integration of the cuts and the areas where the colored pads are to be situated, and in some cases may include a thin plastic film (described below) used as a separation film between the pads.

Examples of extension members include a rubber plate, a fiber string or rubber band to link together the pad bases, a plastic film to link together the pad bases, and a copper spring to link together the pad bases.

With the multicolor stamp pad of the present invention it is preferable that it be possible to perform as one operation the process of stretching the extension member to form gaps between the colored pads. In order to accomplish this, it is preferable that the colored pads be linked at even intervals on the aforementioned extension member. More specifically, one end of which extension member is fastened and the opposite end of which comprises an extension lever. The opposite end is stretched by means of the extension lever so as to pull away from the stationary end. As a result the extension member is stretched, making it possible to separate the individual colored pads at equal intervals. Thus, it is possible to prevent the transfer of aqueous dye-based inks between the adjacent colored pads when not in use.

When the multicolor stamp pad of the present invention is not in use the extension member is maintained in the extended condition so as to maintain the individual colored pads separated from each other. During use the extension member is retracted so that the individual colored pads are brought into close contact with each other. Thus, because the colored pads are not in continuous close contact with each other when not in use, the transfer of the aqueous dye-based inks is prevented.

However, when the colored pads make direct contact with each other while the multicolor stamp pad is being used, it is possible for the aqueous dye-based inks to be transferred during long periods of use. Thus, in order to prevent the transfer of aqueous dye-base inks completely even during use, it is preferable to situate a flexible, ink-impermeable thin film between the adjacent colored pads so as to prevent noticeable blemishes on the stamped image without impeding the stamp-inking process. More specifically a flexible thin film should be adhered to at least one of the surfaces of colored pads in contact with adjacent colored pads.

Thin films that can be used include various plastic films and cellulose films. The film thickness is normally less-than 100 μm, preferably no more than several tens of μm.

Thus, with the present invention it is possible to provide a multicolor stamp pad utilizing aqueous dye-base inks, with which it is possible to completely prevent the transfer of ink between colored pads, and in which colors do not mix easily even during long periods of use.

The following Examples are offered by way of illustration, and not by way of limitation.

EXAMPLES

Example 1

The multicolor stamp pad shown in FIGS. 2 through 6 was prepared in the manner described below.

Figure 3:
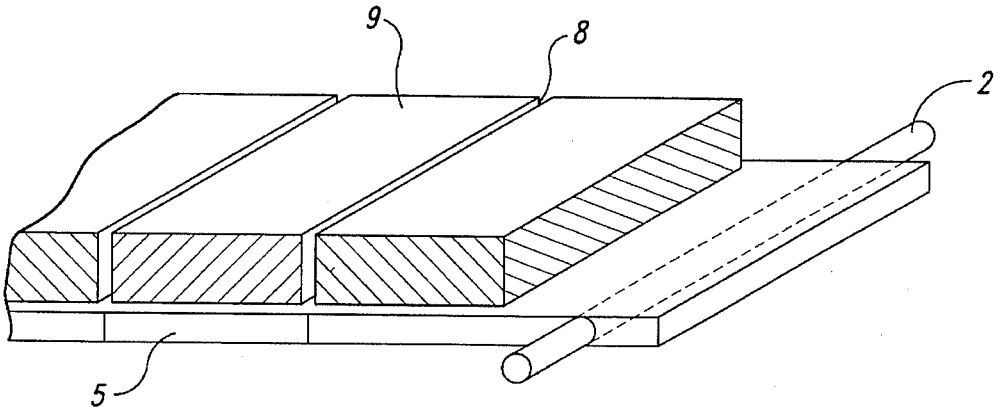
FIG. 3 depicts a perspective view of a portion of a stamp pad according to the present invention wherein individual ink pads are disposed directly upon the N-shaped spring substrate of FIG. 2.
Figure 4:
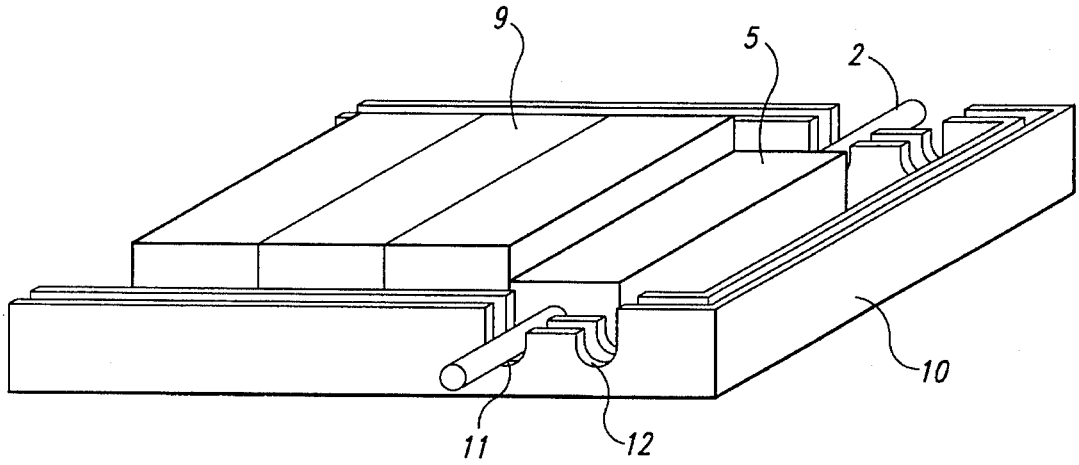
FIG. 4 depicts a perspective view of a stamp pad according to the present invention including an extension member disposed within a base.
Figure 5:
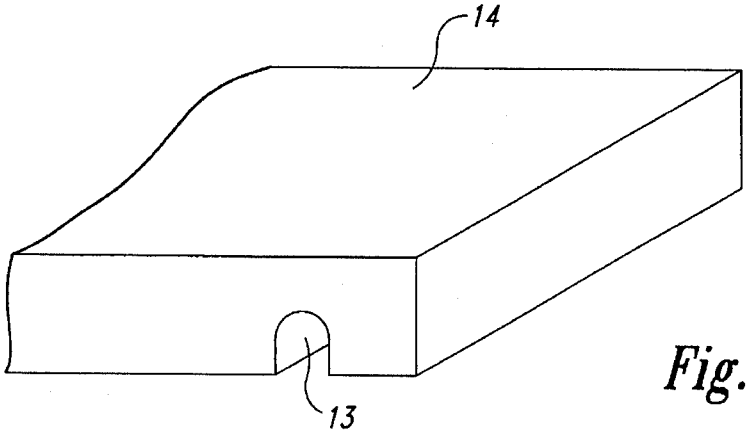
FIG. 5 depicts a perspective view of a lid according to the present invention.
Figure 6:
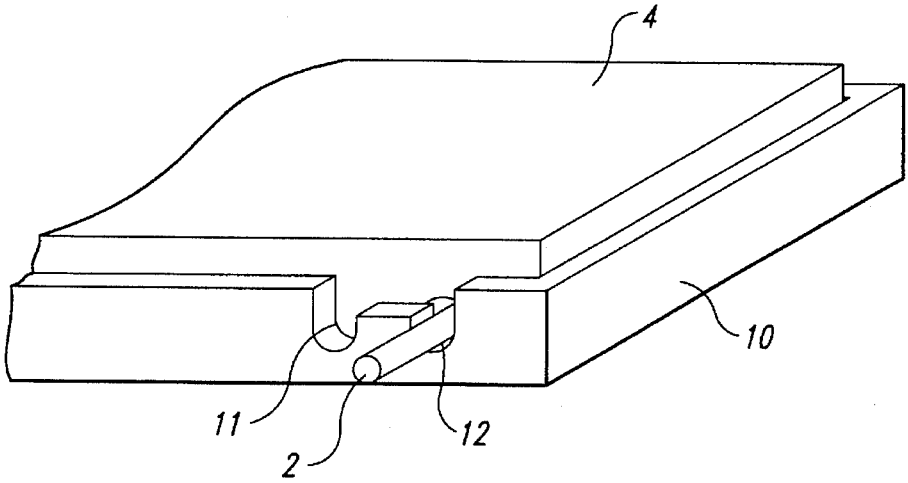
FIG. 6 depicts a perspective view of the lid seated within the base.

As noted previously, FIG. 2 is a top view of an N-shaped spring substrate. FIG. 3 is a perspective view depicting individual ink pads aligned upon an N-shaped spring substrate. FIG. 4 is a perspective view that depicts the N-shaped spring substrate with ink pads mounted in the base of a stamp pad. FIG. 5 is a perspective view of a portion of the lid. FIG. 6 is a perspective view of the lid fitted in the base.

Figure 2A:
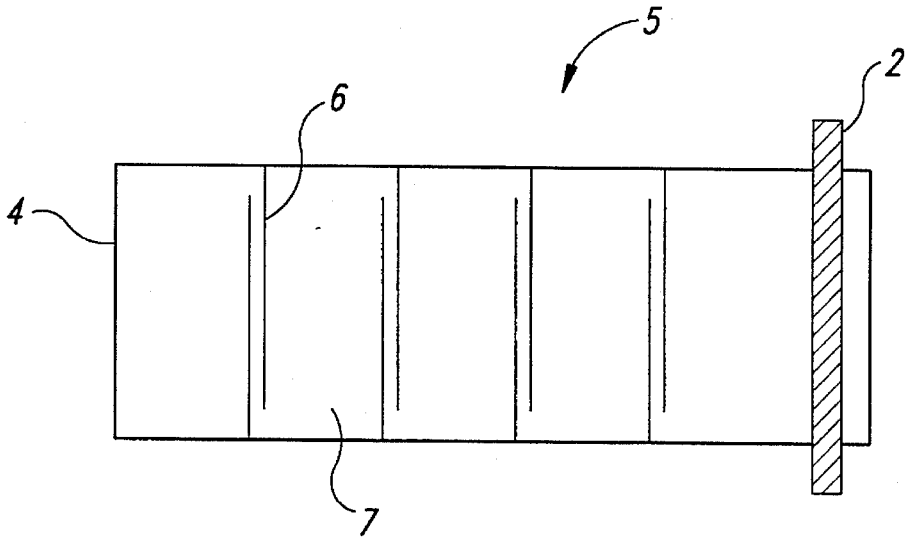
FIGS. 2A–2B depicts a top view of an N-shaped spring substrate extension member according to the present invention. In the upper view (a) the extension member is retracted; in the lower view (b) the extension member is extended.
Figure 2B:
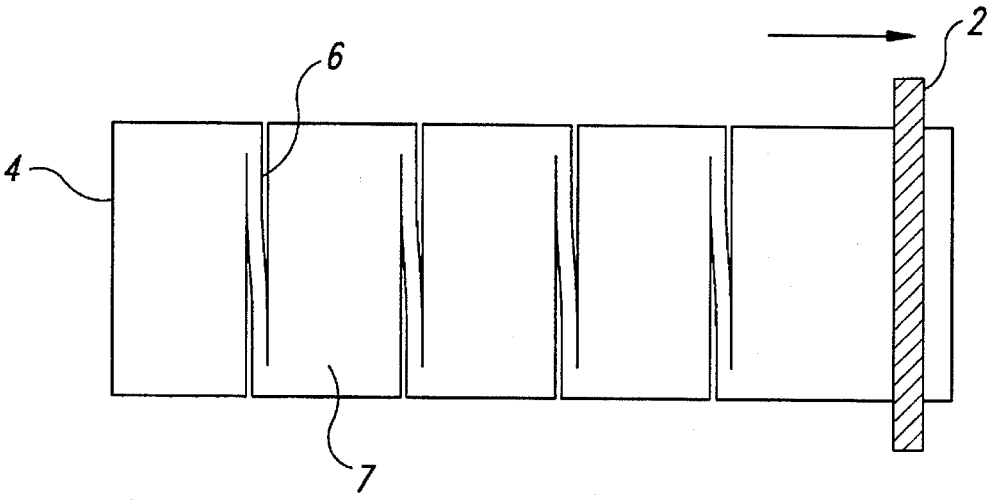

As shown in FIG. 2, groups of two opposing cuts (6) are formed in four locations on the borders (4) where the colored pads are to be situated on a plastic substrate (7) consisting of a hard vinyl chloride plate with a length of 10 cm, width of 5 cm, and thickness of 3 mm. When lever (2) is extended, the cuts (6) are stretched into an N shape. In this manner, an N-shaped spring substrate (5) that functions as a spring was prepared. An extension lever (2) was fastened on one end of the N-shaped spring substrate (5).

Next, as shown in FIG. 3, a thin film (8), consisting of a polyethylene terephthalate film with a thickness of 30 μm onto which an adhesive was coated, was attached to a felt colored pad (9) on the side in contact with an adjacent colored pad (9). Next, five colored pads (9) were attached to the N-shaped spring substrate (5)

The aforementioned N-shaped spring substrate (5) was inserted in the base (10) of a plastic stamp holder and one end was fastened to the base. As shown in FIG. 4, two grooves for locking the extension lever (2) on the N-shaped spring substrate (5) were formed on one end of the base (10). More specifically groove (11) is used when the N-shaped spring substrate (5) retracts, and groove (12) is used when it extends.

Next the individual colored pads (9) were soaked with aqueous dye-base inks in the colors red, orange, yellow, green and blue. As shown in FIG. 5, a single groove for locking the extension lever (2) at a position where the N-shaped spring substrate (5) is extended was formed on a lid (14). More specifically a lid groove (13) used during stretching was formed. The aforementioned extension lid groove (13) was formed in the same location as the extension groove (12) formed on the base (10).

The N-shaped spring substrate (5) was stretched to lock the extension lever (2) into the stretching groove (12), causing all of the colored pads (9) to be pulled apart. At this time it was possible to maintain a gap of approximately 2 mm between the individual colored pads. Next, as shown in FIG. 6, the lid was closed and the unit was stored for one month. No transfer of ink was observed. Next the lid was opened and the colored pads were brought into close contact with each other and maintained in that condition for one week, but no transfer of ink was observed.

Example 2

Figure 7A:
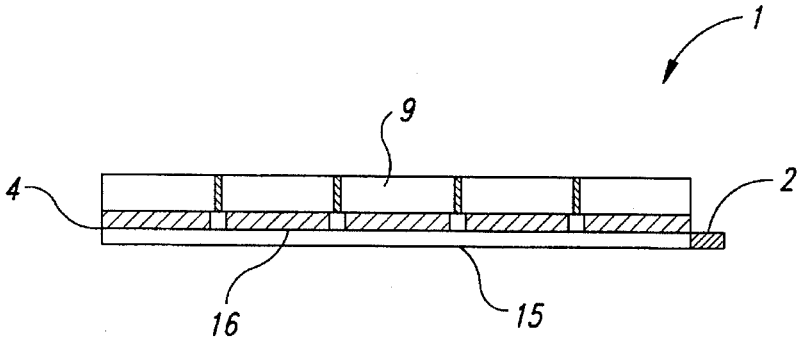
FIGS. 7A–7B depicts a side view of a stamp pad according to the present invention wherein the ink pads are disposed upon pad bases which are in turn disposed upon an extension member. In the upper view (a) the extension member is retracted; in the lower view (b) the extension member is extended.
Figure 7B:
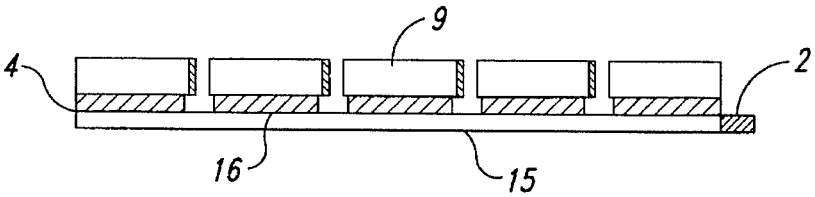

A multicolor stamp pad with an extension member structured as shown in FIG. 7 was prepared in the manner described below.

A natural rubber plate (15) with a thickness of 0.5 mm, length of 10 cm, and width of 5 cm was set in the base of a plastic stamp holder identical to that used in Example 1. One end was fastened with rubber paste. Five pad bases (16), consisting of hard polyvinyl chloride plates with a thickness of 2 mm, length of 5 cm, and width of 1.8 cm were aligned to be parallel to each other in the lengthwise direction on top of the aforementioned rubber plate (15). These were adhered with rubber paste at intervals so that the rubber plate would be slightly stretched after fastening the colored pads (9) close to each other thereon.

A round acrylic resin bar with a diameter of 2 mm and length of 6 cm serving as the extension lever (2) was adhered to the rubber plate (15) outside of the pad bases (16) consisting of hard polyvinyl chloride plates, on the end opposite that on which the rubber plate (15) was fastened to the base of the stamp holder. The colored pads (9) were fastened to the rubber plate (15). A cellophane paper, having a thickness of 40 μm was coated with an adhesive and adhered to the sides of the colored pads (9) that touch adjacent colored pads. Next, the pads were soaked with aqueous dye-base inks in the colors red, orange, yellow, green and blue. As in Example 1, an extension lid groove (13) was formed on the lid so as to lock when the rubber plate (15) was stretched 8 mm.

The rubber plate (15) was stretched to lock the extension lever in the extension groove (12) on the base, thereby causing the various colored pads to pull away. At this time it was possible to maintain a gap of approximately 2 mm between the individual colored pads. Next, as shown in FIG. 6 the lid was closed and the unit was stored for one month. No transfer of ink was observed. Next the lid was opened and the colored pads were brought into close contact with each other and maintained in that condition for one week, but no transfer of ink was observed.

Example 3

Figure 8A:
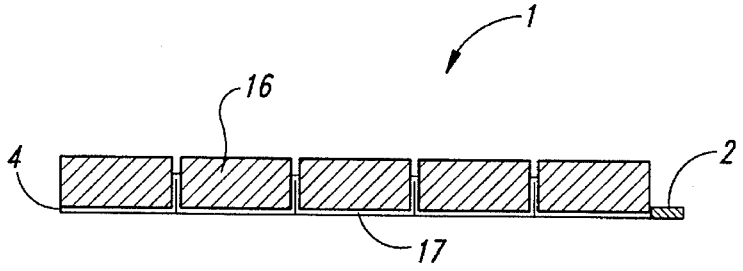
FIGS. 8A–8B depicts a side view of an extension member according to the present invention, wherein when the extension member is retracted it folds upwardly into the inter-pad spaces. In the upper view (a) the extension member is retracted; in the lower view (b) the extension member is extended.
Figure 8B:
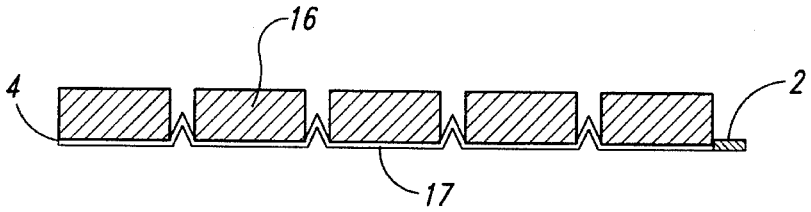

FIG. 8 is an explanatory diagram that illustrates another example of a extension member. The extension member shown in the figure is obtained using a plastic film (17) to link together the pad bases (16) on which the colored pads were situated. Except for the fact that the extension member shown in the figure was used, the multicolor stamp pad was prepared in the same manner as in Example 1.

The lid was closed and the unit was stored for one month. No transfer of ink was observed. Next the lid was opened and the colored pads were brought into close contact with each other and maintained in that condition for one week, but no transfer of ink was observed.

Example 4

Figure 9:
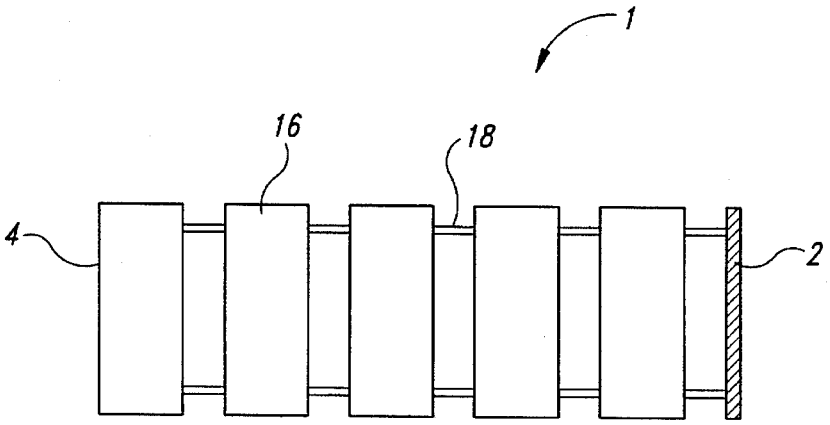
FIG. 9 is a top view of a stamp pad according to the present invention wherein the extension member comprises rubber bands or fiber strings.

FIG. 9 is an explanatory diagram of another example of an extension member. The extension member shown in the figure was obtained using a fiber string or rubber band (18) to link together the pad bases (16) on which the colored pads were situated. Except for the fact that the extension member shown in the FIG. 9 was used, the multicolor stamp pad was prepared in the same manner as in Example 1.

The lid was closed and the unit was stored for one month. No transfer of ink was observed. Next the lid was opened and the colored pads were brought into close contact with each other and maintained in that condition for one week, but no transfer of ink was observed.

Example 5

Figure 10A:
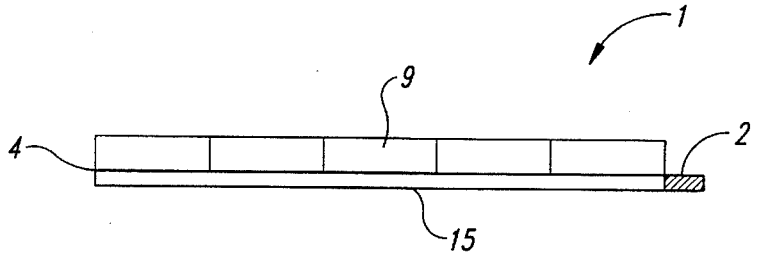
FIGS. 10A–10B depicts a side of an N-shaped spring substrate extension member and ink pads of the present invention wherein the ink pads are disposed directly upon the extension member. In the upper view (a) the extension member is retracted; in the lower view (b) the extension member is extended.
Figure 10B:
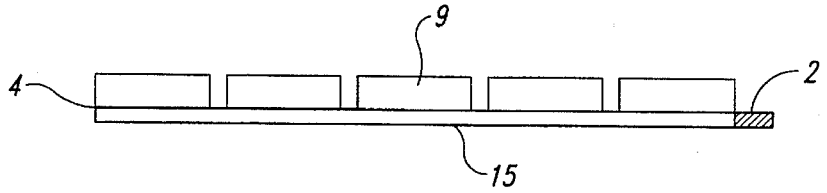
Figure 11:
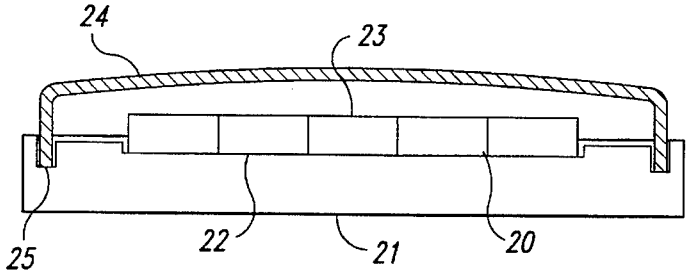
FIG. 11 depicts a side view of a conventional stamp pad wherein the ink pads are maintained in constant contact.
Figure 12:
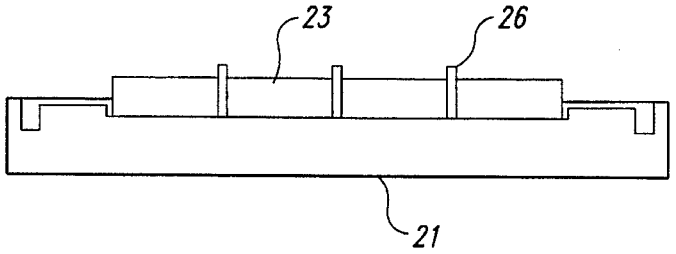
FIG. 12 depicts a side view of a conventional stamp pad wherein the ink pads are separated by plastic partitioning plates.

FIG. 10 is an explanatory diagram of another example of an extension member. The extension member shown in the figure is the same as that presented in Example 2, except that the colored pads (9) were situated directly on the rubber plate (15) without using the pad bases (16). Except for the fact that extension member as shown in the FIG. 10 was used, the multicolor stamp pad was prepared in the same manner as in Example 2.

The lid was closed and the unit was stored for one month. No transfer of ink was observed.

Example 6

A multicolor stamp pad was prepared in the same manner as in Example 1, except that in contrast to Example 1, five colored pads were fastened to the N-shaped spring substrate (5) without attaching a thin film consisting of polyethylene terephthalate to the colored pads.

Although this multicolor pad did not exhibit ink transfer when used for short periods of time, ink transfer was observed during long periods of use.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A multicolor stamp pad comprising a plurality of ink pads disposed in a line on an extension member such that said ink pads contact one another when said extension member is non-extended and do not contact one another when said extension member is extended.

2. The multicolor stamp pad of claim 1 wherein said extension member comprises a rubber plate.

3. The multicolor stamp pad of claim 2 wherein a plurality of pad bases are disposed between said plurality of ink pads and said rubber plate.

4. The multicolor stamp pad of claim 1 wherein said extension member comprises an N-shaped spring substrate comprising a plurality of ink pad areas, said substrate further comprising a first cut in a region between two of said ink pad areas, said first cut extending into said region from a rear edge of said spring substrate, and a second cut in said interpad area, said second cut substantially parallel to said first and cut and extending d into said region from a second edge of said spring substrate.

5. The multicolor stamp pad of claim 1 wherein said extension member comprises one or both of rubber bands or extensible fiber strings said rubber bands or fiber strings linking together said plurality of ink pads.

6. The multicolor stamp pad of claim 1 wherein said extension member comprises an extendible and retractable plastic film.

7. The multicolor stamp pad of claim 1 wherein said extension member comprises a spring.

8. The multicolor stamp pad of any one of claims 1–7 wherein a first end of said extension member is fastened to a base of said stamp pad and a second end of said extension member is attached to a handle capable of extending and retracting said extension member.

9. The multicolor pad of any one of claims 1–7 in which a flexible thin, water-impermeable film is adhered to at least one side of said ink pads that makes contact with adjacent ink pads.

10. A multicolor stamp pad comprising a plurality ink pads disposed in a line on an extendible and retractable extension member such that said ink pads are leveled towards one another by said extension member when said extension member is retracted and said ink pads are forced apart by said extension member when said extension member is extended.

11. The multicolor stamp pad of claim 10 wherein said extension member comprises a rubber plate.

12. The multicolor stamp pad of claim 11 wherein a plurality of pad bases are disposed between said plurality of ink pads and said rubber plate.

13. The multicolor stamp pad of claim 10 wherein said extension member comprises an N-shaped spring substrate comprising a plurality of ink pad areas, said substrate further comprising a first cut in a region between two of said ink pad areas, said first cut extending into said region from a rear edge of said spring substrate, and a second cut in said interpad area, said second cut substantially parallel to said first cut and extending d into said region from a second edge of said spring substrate.

14. The multicolor stamp pad of claim 10 wherein said extension member comprises one or both of rubber bands or extensible fiber strings, said rubber bands or fiber strings linking together said plurality of ink pads.

15. The multicolor stamp pad of claim 10 wherein said extension member comprises an extendible and retractable plastic film.

16. The multicolor stamp pad of claim 10 wherein said extension member comprises a spring.

17. The multicolor stamp pad of any one of claims 10–16 wherein a first end of said extension member is fastened to a base of said stamp pad and a second end of said extension member is attached to a handle capable of extending and retracting said extension member.

18. The multicolor pad of any one of claims 10–16 in which a flexible thin, water-impermeable film is adhered to at least one side of said ink pads that makes contact with adjacent ink pads.

* * * * *